US010278266B1

(12) United States Patent
Walma et al.

(10) Patent No.: US 10,278,266 B1
(45) Date of Patent: Apr. 30, 2019

(54) LIGHT MODULATED NETWORK PASSWORD KEY DELIVERY

(71) Applicant: Cooper Technologies Company, Houston, TX (US)

(72) Inventors: Kenneth Dale Walma, Peachtree City, GA (US); James Moan, Peachtree City, GA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/371,528

(22) Filed: Dec. 7, 2016

Related U.S. Application Data

(60) Provisional application No. 62/264,148, filed on Dec. 7, 2015.

(51) Int. Cl.

| | |
|---|---|
| ***H05B 37/00*** | (2006.01) |
| ***H05B 37/02*** | (2006.01) |
| ***H05B 33/08*** | (2006.01) |
| ***G08C 17/02*** | (2006.01) |
| ***G08C 23/04*** | (2006.01) |

(52) U.S. Cl.
CPC ..... *H05B 37/0272* (2013.01); *G08C 17/02* (2013.01); *G08C 23/04* (2013.01); *H05B 33/0845* (2013.01)

(58) Field of Classification Search
CPC ..... H05B 37/0227; H05B 37/0218; H05B 37/0245; H05B 37/02; H05B 37/0272; H05B 33/0815; H05B 33/0845; H05B 37/0254; H05B 33/0812; H05B 33/0818; H05B 37/0263; H05B 33/0803; H05B 33/0824
See application file for complete search history.

(56) References Cited

U.S. PATENT DOCUMENTS

2014/0265870 A1* 9/2014 Walma ..... H05B 37/0218 315/151

* cited by examiner

*Primary Examiner* — Monica C King
(74) *Attorney, Agent, or Firm* — King & Spalding LLP

(57) ABSTRACT

A lighting device includes a light source to emit a modulated light, a memory device for storing an access code of a wireless network, and a controller to control generation of the modulated light based on the access code, wherein the access code is extractable from the modulated light by a light receiving device.

20 Claims, 5 Drawing Sheets

LIGHT MODULATED NETWORK PASSWORD KEY DELIVERY

RELATED APPLICATIONS

The present application claims priority under 35 U.S.C. § 119(e) to U.S. Provisional Patent Application No. 62/264,148, filed Dec. 7, 2015, and titled "Light Modulated Network Password Key Delivery," the entire content of which is incorporated herein by reference.

TECHNICAL FIELD

The present disclosure relates generally to securing access to a wireless network, in particular to using a modulated light to provide an access code for accessing a wireless network.

BACKGROUND

Robust wireless networks require password authentication between two devices. In addition, certain mobile devices and operating systems require physical input (e.g., typing) of wireless password keys (i.e., access code) to access a wireless network. Some existing methods of providing a network password key include printing labels on devices or literature, maintaining spreadsheets, using push buttons to authenticate devices, or requiring users to ask devices to broadcast their network IDs over the RF network, which sacrifices security.

Thus, means for securely providing network password keys/access codes to allow users to access a network is desirable.

SUMMARY

The present disclosure relates generally to securing access to a wireless network, in particular to using a modulated light to provide an access code for accessing a wireless network. In an example embodiment, a lighting device includes a light source to emit a modulated light, a memory device for storing an access code of a wireless network, and a controller to control generation of the modulated light based on the access code, wherein the access code is extractable from the modulated light by a light receiving device.

In another example embodiment, a system for providing a mobile device access to a wireless network includes a lighting device having a light source that emits a modulated light, a lighting fixture configured to wirelessly communicate over a wireless network, and a mobile device configured to receive the modulated light, extract an access code from the modulated light, and use the access code to communicate with the lighting fixture over the wireless network.

In another example embodiment, a method for communicating with a lighting fixture via a wireless network includes receiving, by a mobile device, a modulated light emitted by a light source of a lighting device, extracting, by the mobile device, an access code from the modulated light, and accessing, by the mobile device, a wireless network using the access code, wherein the lighting device and a lighting fixture are connected to the wireless network.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
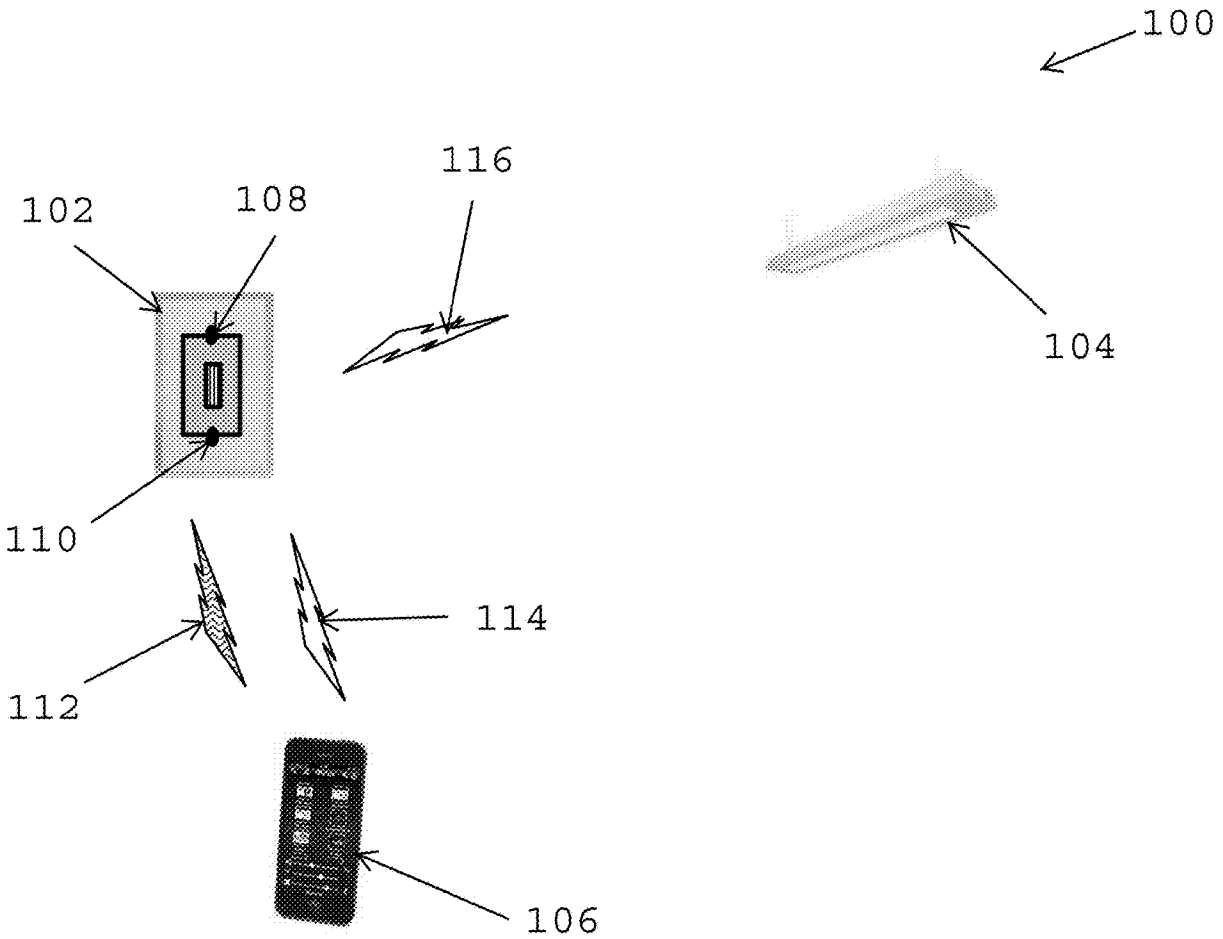
FIG. 1 illustrates a system for providing a mobile device access to a wireless network according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s). As used in this specification, the terms "wireless" and "wirelessly" are intended not to refer to light based communication, network or signal.

Turning now to the drawings, FIG. 1 illustrates a system 100 for providing a mobile device 106 access to a wireless network according to an example embodiment. As illustrated in FIG. 1, the system 100 may include a lighting device 102, a lighting fixture 104, and a mobile device 106. In some example embodiments, the lighting device 102 may wirelessly communicate with the lighting fixture 104 over a wireless network. As described in more detail with respect to FIG. 5, the lighting device 102 may include a wireless communication circuit to transmit and receive wireless electrical signals such as the wireless signals 116. The lighting fixture 104 may be a suspended lighting fixture or another type of lighting fixture that emits light to illuminate an area and that includes a wireless communication circuit to wirelessly receive and/or transmit electrical wireless signals such as the wireless signals 116. The lighting device 102 may wirelessly communicate with the lighting fixture 104 using wireless signals 116.

In some example embodiments, the lighting device 102 may wirelessly control operations of the lighting fixture 104. Alternatively or in addition, the lighting device 102 may be wired to the lighting fixture 104 and control operations of the lighting fixture 104 over a wired connection. To illustrate, the lighting device 102 may turn on, turn off, dim, etc. the lighting fixture 104 by transmitting commands wirelessly using the wireless signals 116 or via electrical wiring.

In some example embodiments, the lighting device 102 may also receive wireless signals from the lighting fixture 104. For example, the lighting device 102 may receive status information from the lighting fixture 104 over the wireless network. Alternatively, the lighting device 102 may receive information, such as status information, from the lighting fixture 104 over a wired connection.

In some example embodiments, the lighting device 102 may be a lighting control device. For example, the lighting device 102 may be a wall switch, a dimmer, or another wall mounted lighting control device. The lighting device 102 may also include a light source 108 that can emit a modulated light 112. For example, the light source 108 may be a light emitting diode (LED) that can transmit a modulated light. To illustrate, the lighting device 102 may transmit, using the modulated light 112, an access code that is used to access a wireless network that is used by the lighting device 102 and the lighting fixture 104 for wireless communication. For example, the lighting device 102 may include a controller/processor to control the generation of the modulated light 112 based on the access code. A device that receives the modulated light 112 may extract the access code and join the wireless network using the access code.

Generation of the modulated light 112 using the access code may be performed by the lighting device 102 by a means known to those of ordinary skill in the art to generate a modulated light. For example, an electrical signal encoded with the access code may be provided to the light source 108. In some example embodiments, the lighting device 102 may include a modulator that generates the modulated light signal 112 based on the access code. The modulated light 112 may switch between on and off and/or at different intensity levels corresponding to the access code. The switching of the modulated light 112 may occur at a high enough rate such that the switching is not detectable or noticeable by occupants exposed to the modulated light 112.

In some example embodiments, the access code may be stored in a memory device of the lighting device 102, and the lighting device 102 may transmit the access code using the modulated light 112 after retrieving the access code from the memory device. For example, the lighting device 102 may obtain one or more access codes from another source such as the lighting fixture 104 wirelessly over the wireless network and store the access codes in the memory device of the lighting device 102. The lighting device 102 may then retrieve an access code from the memory device and transmit the access code using the modulated light 112. Alternatively, instead of transmitting an access code stored in the lighting device 102, the lighting device 102 may obtain the access code from another source such as the lighting fixture 104 and transmit the received access code using the modulated light 112 without storing the access code.

In some example embodiments, the access code may be a temporary access code that is valid for accessing the wireless network for a duration of time (e.g., 1 hour, 2 hours, 24 hours, etc.). Alternatively, the access code may be valid for accessing the wireless network until the code required to access the network is changed. In some example embodiments, multiple access codes may be stored in the lighting device 102, and the lighting device 102 may select one of the access codes. For example, some of the access codes stored in the memory device may be temporary access codes that expire after a duration of time following the transmission of the access code by the lighting device 102 using the modulated light 112. In some example embodiments, the duration of access using the access code may be user defined. In some example embodiments, the lighting device 102 may determine whether the access code has expired and may refuse an attempt to wirelessly communicate to and/or through the lighting device 102. In some example embodiments, the access code may be used to access the wireless network but may be hidden and/or inaccessible from a user of the mobile device.

In some example embodiments, the lighting device 102 may also include a button 110 or another mechanism that is used to initiate transmission of the access code by the lighting device 102. For example, the lighting device 102 may transmit the access code using the modulated light 112 when a user presses the button 112. Alternatively, the lighting device 102 may transmit the access code using the modulated light 112 when transmission is initiated by other means, such as a timer, etc. In some example embodiments, the lighting device 102 may transmit the access code using the modulated light 112 without the transmission being initiated by a user input. For example, the transmission of the access code by the lighting device 102 using the modulated light 112 may be initiated by a command received wirelessly by the lighting device 102 from another device with a wireless network access. Alternatively, the lighting device 102 may periodically transmit the access code using the modulated light 112.

In some example embodiments, the mobile device 106 may need the access code transmitted by the lighting device 102 in order to communicate wirelessly using electrical wireless signals 114. To illustrate, the mobile device 106 may receive the modulated light 112 and extract the access code from the modulated light 112. The mobile device 106 may have an application/software for extracting the access code from the modulated light 112. For example, the mobile device 106 may include a camera or a photoreceptor that captures the modulated light 112 transmitted by the light source 108 of the lighting device 102, and the application may retrieve the access code from the received modulated light. The mobile device 106 may be a mobile phone, a tablet, a laptop, etc.

After extracting the access code, the mobile device 106 may access the wireless network that is accessible using the access code. For example, the mobile device 106 may access other devices on the wireless network through the lighting device 102 by using the wireless signals 114 and the extracted access code. In some example embodiments, the mobile device 106 may communicate with the lighting device 102 using the wireless signals 114 based on one or more wireless communication protocols (e.g., Wi-Fi, Bluetooth, a proprietary protocol, etc.). To illustrate, the mobile device 106 may establish communication with the lighting device 102 using the access code extracted from the modulated light 112 and may communicate with the lighting fixture 104 through the lighting device 102 based on a communication protocol. For example, the lighting device 102 may serve as a point of access to the wireless network used by the lighting fixture 104 to allow the mobile device 106 to communicate with the lighting fixture 104.

Once the mobile device 106 is able to wirelessly access other devices, such as the lighting fixture 104, through the lighting device 102, an application on the mobile device 106 may be used to remotely control the operation of the lighting fixture 104. For example, the mobile device 106 may control the operation of the lighting fixture 104 based on a lighting control standard known to those of ordinary skill in the art.

In some example embodiments, the lighting device 102 may process information/instructions (e.g., lighting fixture control commands) received from the mobile device 106 via the wireless signals 114 and may determine whether to pass the information/instructions to the lighting fixture 104 or to another device connected. For example, when the lighting device 102 receives a lighting instruction intended for the lighting fixture 104 using the wireless signal 114, the lighting device 102 may first determine whether the access code is still valid. To illustrate, the lighting device 102 may determine that the time duration of the access code provided to the mobile device 106 for accessing the wireless network used by the lighting fixture 104 has expired and terminate the instruction.

By providing the access code to the mobile device 106 using the modulated light 112, access to devices on a wireless network may be provided in a convenient and secure manner. Providing the mobile device a wireless communication path through the lighting device 102 also enables the lighting device 102 to monitor whether the access code has expired.

Although the light source 108 is shown as part of the lighting device 102, in some alternative embodiments, the light source 108 may be separate from the lighting device 102. Further, the modulated light 112 emitted by the light source 108 may be a modulated visible light or a modulated infrared light. In some alternative embodiments, the system 100 may include other devices such as other lighting fixtures, lighting control devices, sensors, etc.

Figure 2:
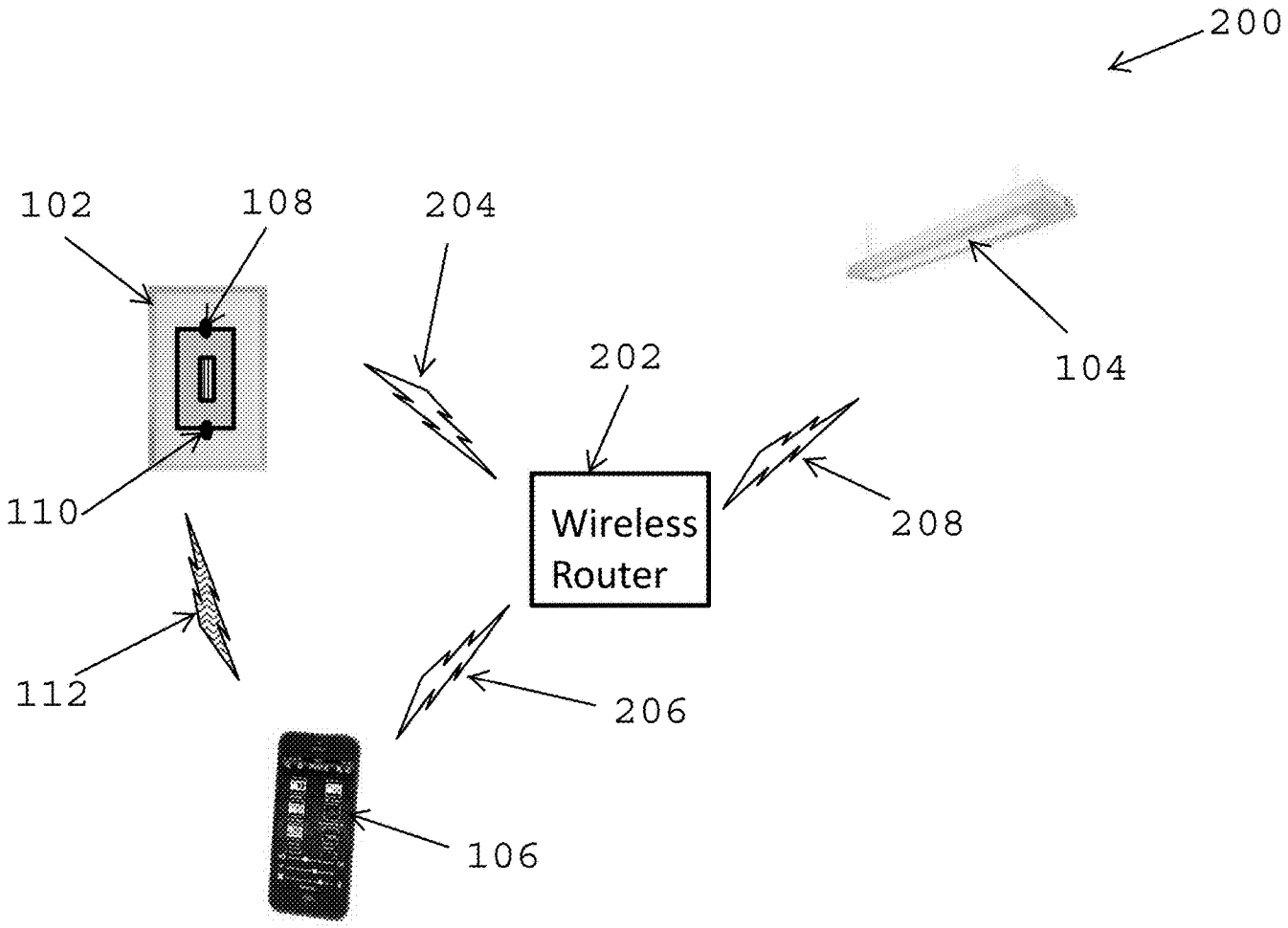
FIG. 2 illustrates a system for providing a mobile device access to a wireless network according to another example embodiment.

FIG. 2 illustrates a system 200 for providing a mobile device 106 access to a wireless network according to another example embodiment. The system 200 includes the lighting device 102, the lighting fixture 104, and the mobile device 106 described with respect to FIG. 1. The system 200 also includes a wireless router 202. In contrast to the system 100 of FIG. 1, in the system 200, the lighting device 102, the lighting fixture 104, and the mobile device 106 communicate with each other via the wireless router 202.

In some example embodiments, the access code to the wireless network that includes the lighting device 102, the lighting fixture 104, and the wireless router 202 is provided to the mobile device 106 in the same manner as described with respect to FIG. 1. For example, the access code may be stored in a memory device of the lighting device 102, and the lighting device 102 may generate the modulated light using the access code retrieved/read from the memory device. Alternatively, the lighting device 102 may receive the access code, for example, wirelessly from another device such as the lighting fixture 104, and generate the modulated light 112 without storing the access code. The access code may also be a temporary code or may be selected from among multiple access codes as described above. The transmission of the access code using the modulated light 112 may be initiated in the same manner as described above. Alternatively, the lighting device 102 may periodically transmit the access code using the modulated light 112.

In some example embodiments, the lighting device 102 may communicate with the wireless router 202 using electrical wireless signals 204. The lighting fixture 104 may communicate with the wireless router 202 using electrical wireless signals 208. After receiving the modulated light 112 and extracting the access code from the lighting device 102, the mobile device 106 may join the wireless network. To illustrate, the mobile device 106 may communicate with the wireless router 202 using electrical wireless signals 206. For example, the mobile device 106 may control operations of the lighting fixture 104 by communicating through the wireless router 202, which involves using the wireless signals 206 and 208.

In some example embodiments, the wireless signals 204, 206, 208 may be compliant with a wireless communication protocol (e.g., IEEE 802.11 standards, a proprietary protocol, etc.). The mobile device 106 may use a standard lighting control protocol to control operations of the lighting device.

By providing the access code to the mobile device 106 using the modulated light 112, access to devices on the wireless network may be provided through the router 202 in a convenient and secure manner.

In some alternative embodiments, the system 200 may include other devices such as other lighting fixtures, lighting control devices, sensors, etc.

Figure 3:
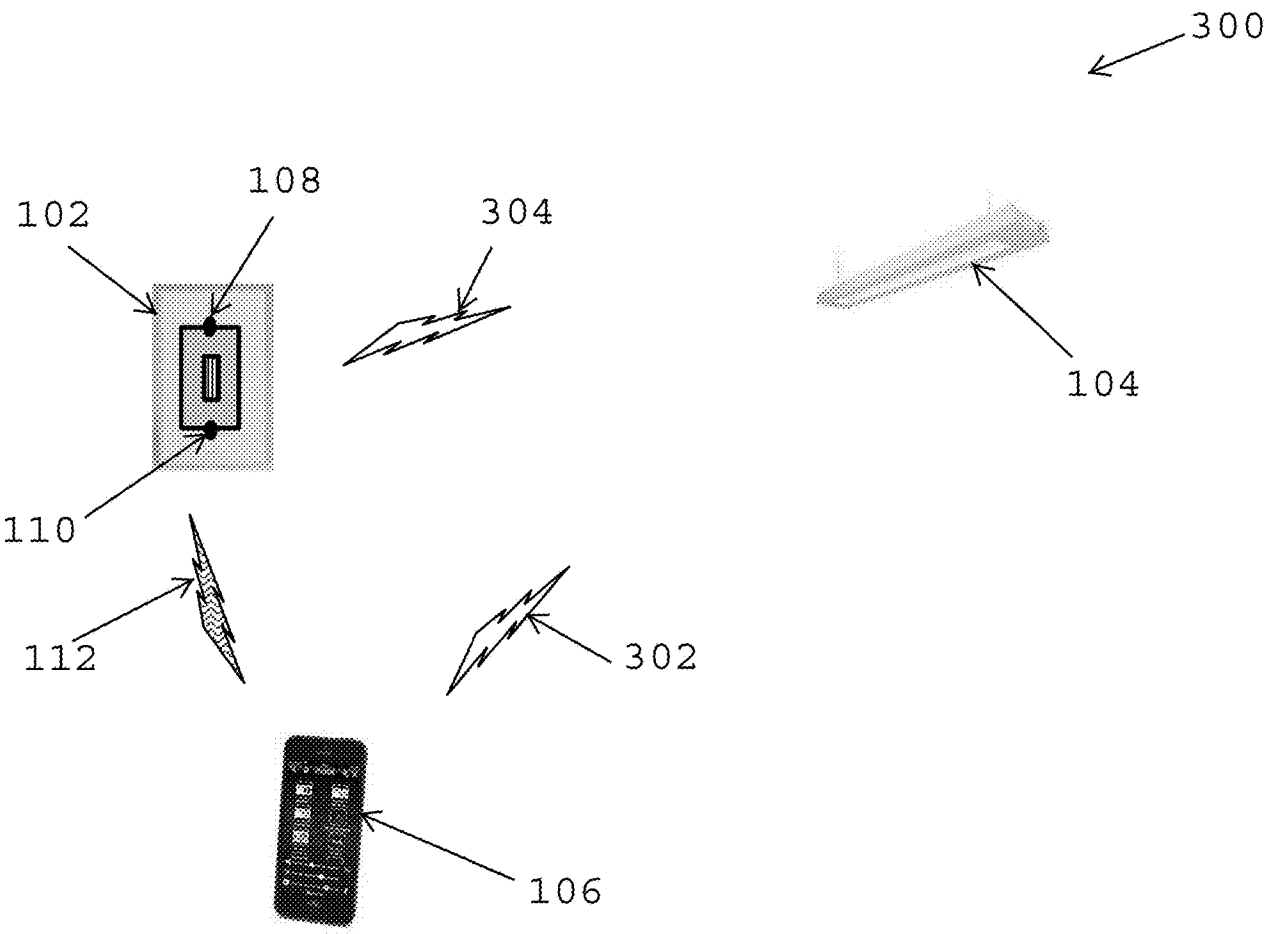
FIG. 3 illustrates a system for providing a mobile device access to a wireless network according to another example embodiment.

FIG. 3 illustrates a system 300 for providing a mobile device 106 access to a wireless network according to another example embodiment. The system 300 includes the lighting device 102, the lighting fixture 104, and the mobile device 106 described with respect to FIGS. 1 and 2. In contrast to the system 100 of FIG. 1 and the system 200 of FIG. 2, in the system 300, the mobile device 106 and the lighting fixture 104 communicate with each other using electrical wireless signals 302 without the use of the lighting device 102 and the wireless router 202 as an intermediate device. In the system 300, the mobile device 106 may wirelessly communicate directly with the lighting fixture 104 after obtaining the access code.

In some example embodiments, the access code to the wireless network that includes the lighting device 102 and the lighting fixture 104 is provided to the mobile device 106 in the same manner as described with respect to FIGS. 1 and 2. For example, the access code to the network may be stored in a memory device of the lighting device 102, and the lighting device 102 may generate the modulated light 112 using the access code retrieved/read from the memory device. Alternatively, the lighting device 102 may receive the access code, for example, wirelessly from another device such as the lighting fixture 104, and generate the modulated light 112 without storing the access code. The access code may also be a temporary code or may be selected from among multiple access codes as described above. The transmission of the access code using the modulated light 112 may also be initiated in the same manner as described above. Alternatively, the lighting device 102 may periodically transmit the access code using the modulated light 112.

After the mobile device 106 extracts the access code from the modulated light 112 as described above, the mobile device 106 and the lighting fixture 104 may communicate wirelessly with each other using the electrical wireless signals 302 for the duration that the access code remains valid. The mobile device 106 may also communicate with the lighting device 104 using electrical wireless signals. The lighting device 102 may continue to communicate with the lighting fixture 104 using electrical wireless signals 304.

In some example embodiments, the wireless signals 302 and 304 may be compliant with a wireless communication protocol (e.g., IEEE 802.11 standards, a proprietary protocol, etc.). The mobile device 106 may use a standard lighting control protocol to control operation of the lighting device.

By providing the access code to the mobile device 106 using the modulated light 112, access to devices on the wireless network may be granted to the mobile device 106 in a convenient and secure manner.

Figure 4:
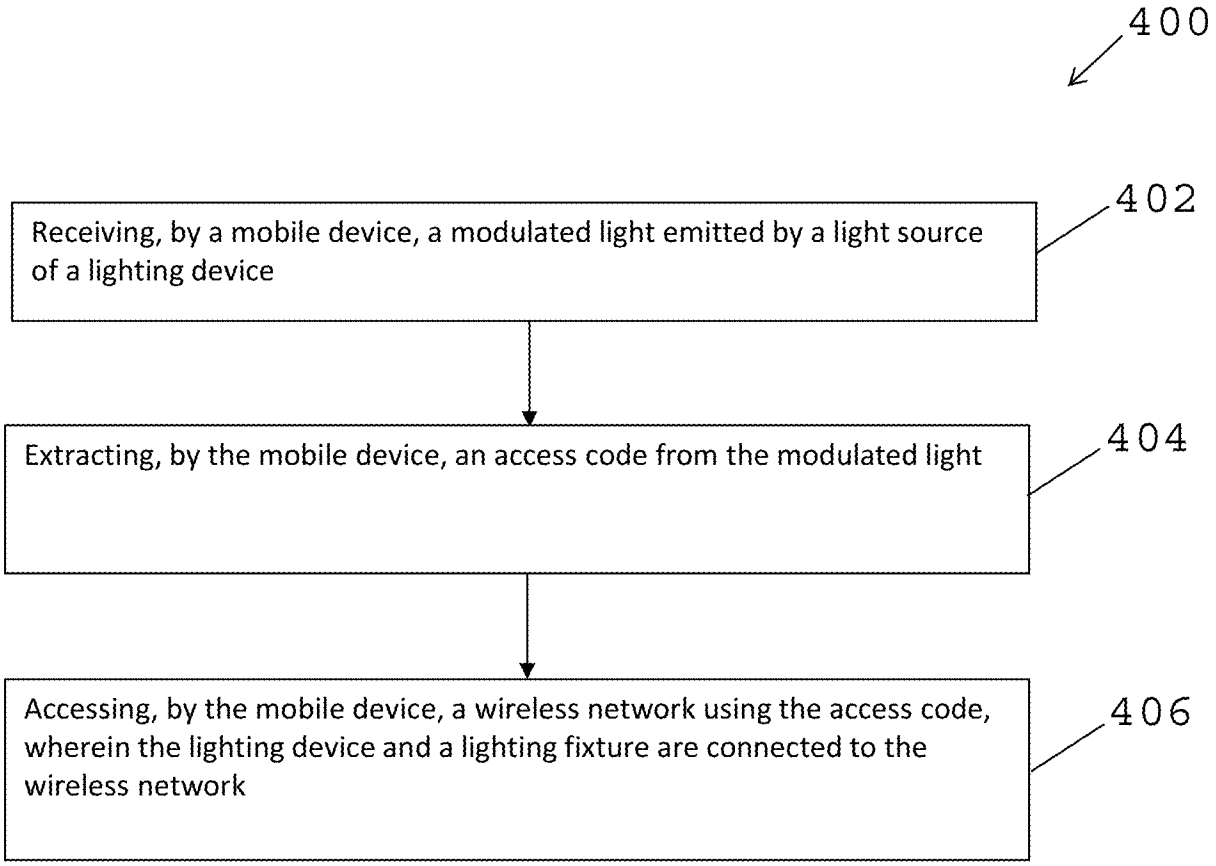
FIG. 4 illustrates a flowchart of a method of providing a mobile device access to a wireless network according to an example embodiment.

FIG. 4 illustrates a flowchart of a method 400 of providing a mobile device 106 access to a wireless network according to an example embodiment. Referring to FIGS. 1-4, in some example embodiments, the method 400 includes, at step 402, receiving, by a mobile device, a modulated light emitted by the light source of the lighting device. For example, the mobile device 106 may receive the modulated light 112 emitted by the light source 108 of the lighting device 102.

At step 404, the method 400 includes extracting, by the mobile device, an access code from the modulated light. For example, the mobile device 106 may extract an access code from the modulated light 112. At step 406, the method 400 includes accessing, by the mobile device, a wireless network using the access code, where the lighting device and a lighting fixture are connected to the wireless network. For example, using the access code that the mobile device extracted from the modulated light 112, the mobile device 106 may access the wireless network that includes the lighting device 102 and the lighting fixture 104. The mobile device 106 may access the wireless network through the lighting device 102 as described with respect to the system 100 of FIG. 1. Alternatively, the mobile device 106 may access the wireless network through the router 202 as described with respect to the system 200 of FIG. 2 or directly as described with respect to the system 300 of FIG. 3.

In some example embodiments, the method 400 may also include initiating a transmission of the access code from the lighting device 102 to the mobile device 106. For example, in response to the initiating of the transmission of the access code, the light source 108 of the lighting device 102 may emit the modulated light 112, which is generated based on the access code. As described above, a user may press the button 110 on the lighting device 102 to initiate the transmission of the access code. Alternatively, the transmission of the access code using the modulated light 112 may be initiated by other means such as instruction received wirelessly from another device. In some alternative embodiments, the lighting device 102 may transmit the access code periodically or at particular times without a user or a remote device initiating the transmission.

Figure 5:
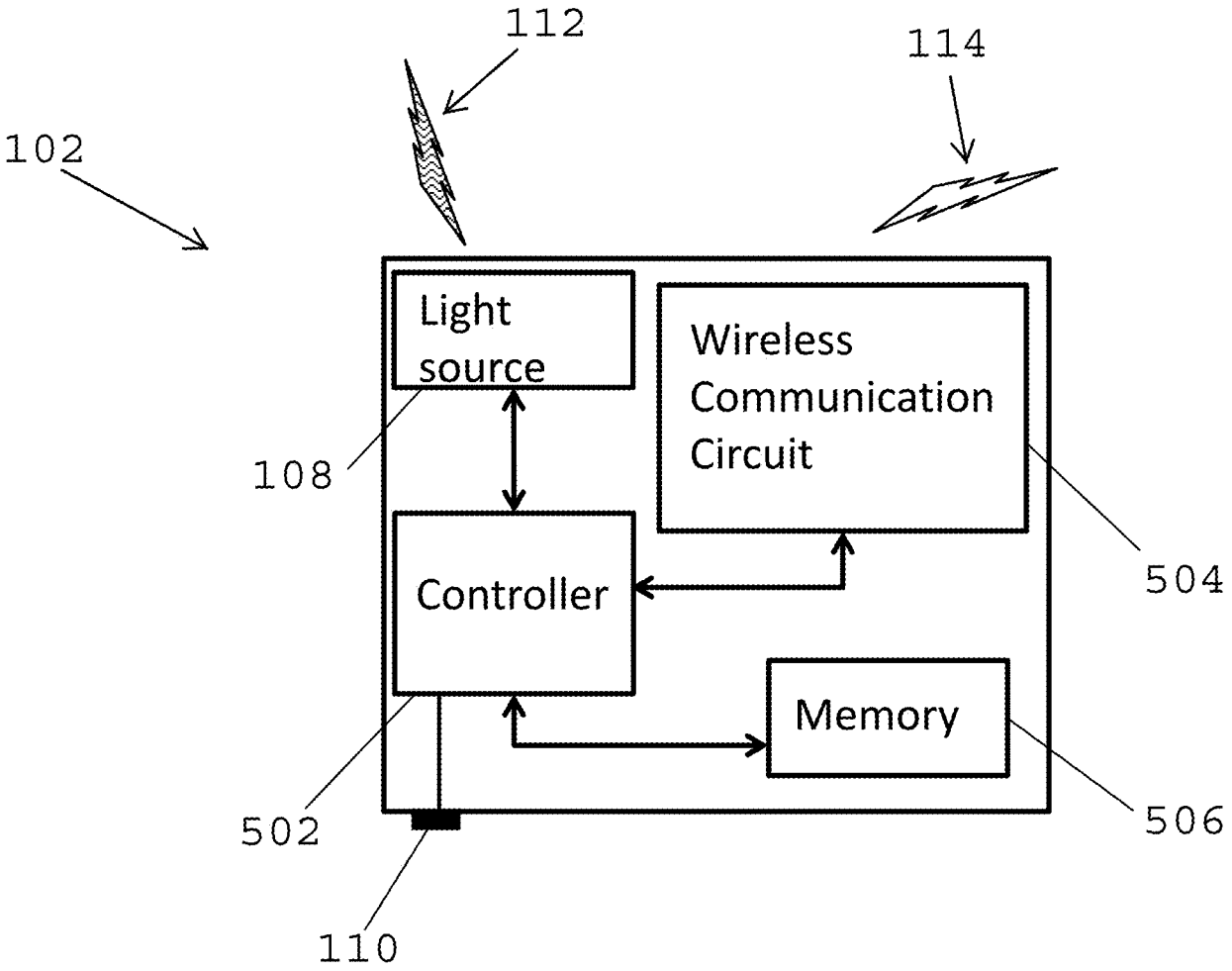
FIG. 5 illustrates the lighting device of FIGS. 1-3 according to an example embodiment.

FIG. 5 illustrates the lighting device 102 of FIGS. 1-3 according to an example embodiment. As illustrated in FIG. 5, the lighting device 102 may include a controller 502 (e.g., a microcontroller or a microprocessor), a wireless communication circuit 504, and a memory device 506 (e.g., SRAM). Referring to FIGS. 1-5, the lighting device 102 may also include the light source 108 that emits the modulated light 112 as described above. The lighting device 102 may also include the button 110 that is used to initiate the transmission of the modulated light 112, and thus, the access code.

In some example embodiments, the access code may be stored in the memory device 506, and the lighting device 102 may transmit the access code using the modulated light 112 after retrieving the access code from the memory device 506. For example, several access codes may be stored in the memory device 506, and the controller 502 may retrieve one of the stored access codes from the memory and provide the access code to the light source to generate the modulated light 112. The memory device 506 may also include software code for execution by the controller 502 to perform various operations.

In some example embodiments, the light source 108 may include one or more light emitting diodes (LEDs) along with the circuitry for the light source 108 to emit the modulated light 112. For example, the light source 108 may receive the access code received from the controller 502, and generate the modulated light 112 based on the access code. Alternatively, the light source 108 may receive from the controller an electrical signal encoded with the access code and emit the modulated light 112. The modulated light 112 may be a modulated visible light or a modulated infrared light that may be demodulated/decoded by a light receiving device to extract the access code.

In some example embodiments, the lighting device 102 may communicate wirelessly using electrical wireless signals 114 that are transmitted and received by the wireless communication circuit 504. For example, the lighting device 102 may wirelessly communicate with the mobile device 106 using the wireless signals 114. Further, the lighting device 102 may communicate wirelessly using electrical wireless signals 116, 204, 304 (shown in FIGS. 1-3) that are transmitted and received by the wireless communication circuit 504. For example, the lighting device 102 may wirelessly control lighting fixture 104 by transmitting and receiving the wireless signals 116, 204, 304.

In some alternative embodiments, the lighting device 102 may include other components in addition to or instead of the components shown in FIG. 5 without departing from the scope of this disclosure. In some example embodiments, some the components of the lighting device 102 shown in FIG. 5 may be integrated into a single component without departing from the scope of this disclosure. Further, one or more of the components (e.g., the button 110) may be omitted without departing from the scope of this disclosure.

Although particular embodiments have been described herein, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A lighting device, comprising:

a light source to emit a modulated light;

a memory device for storing an access code of a radiofrequency wireless network, wherein the radiofrequency wireless network is used for radiofrequency wireless communication; and a controller to control generation of the modulated light based on the access code of the radiofrequency wireless network, wherein the access code of the radiofrequency wireless network is extractable from the modulated light by a light receiving device.

2. The lighting device of claim 1, further comprising a wireless communication circuit to transmit and receive wireless signals over the radiofrequency wireless network.

3. The lighting device of claim 1, wherein the lighting device is configured to wirelessly control operations of a lighting fixture over the radiofrequency wireless network.

4. The lighting device of claim 3, wherein the lighting device is configured to wirelessly receive instructions from a mobile device that uses the access code and to transmit the instructions to the lighting fixture over the radiofrequency wireless network.

5. The lighting device of claim 1, wherein the lighting device is configured to receive the access code using an electrical wireless signal and to store the access code in the memory device.

6. The lighting device of claim 1, further comprising a push button to initiate transmission of the modulated light.

7. The lighting device of claim 1, wherein the lighting device is a wall switch.

8. A system for providing a mobile device access to a radiofrequency wireless network, the system comprising:

a lighting device having a light source that emits a modulated light;

a lighting fixture configured to wirelessly communicate over a radiofrequency wireless network, wherein the radiofrequency wireless network is used for radiofrequency wireless communication; and a mobile device configured to receive the modulated light, extract an access code of the radiofrequency wireless network from the modulated light, and use the access code to communicate with the lighting fixture over the radiofrequency wireless network.

9. The system of claim 8, wherein the lighting device is configured to wirelessly communicate over the radiofrequency wireless network.

10. The system of claim 8, wherein the mobile device is configured to control the lighting fixture through the lighting device by wirelessly communicating with the lighting device using the access code after extracting the access code from the modulated light.

11. The system of claim 8, wherein the mobile device is configured to control the lighting fixture by wirelessly communicating directly with the lighting fixture over the radiofrequency wireless network using the access code after extracting the access code from the modulated light.

12. The system of claim 8, further comprising a wireless network router that is connected to the radiofrequency wireless network, wherein the mobile device controls the lighting fixture through the wireless network router by wirelessly communicating with the wireless network router over the radiofrequency wireless network using the access code after extracting the access code from the modulated light.

13. The system of claim 8, wherein the lighting device is configured to wirelessly communicate with the lighting fixture over the radiofrequency wireless network.

14. The system of claim 8, wherein the lighting device is configured to control the lighting fixture.

15. A method of accessing a radiofrequency wireless network, the method comprising:

receiving, by a mobile device, a modulated light emitted by a light source of a lighting device;

extracting, by the mobile device, an access code of the radiofrequency wireless network from the modulated light; and accessing, by the mobile device, the radiofrequency wireless network using the access code, wherein the lighting device and a lighting fixture are connected to the radiofrequency wireless network and wherein the radiofrequency wireless network is used for radiofrequency wireless communication.

16. The method of claim 15, further comprising initiating a transmission of the access code from the lighting device to the mobile device, wherein the light source of the lighting device emits the modulated light generated based on the access code in response to the initiating of the transmission of the access code.

17. The method of claim 15, wherein the access code is a temporary access code.

18. The method of claim 15, wherein the access code is hidden from a user of the mobile device after the mobile device extracts the access code from the modulated light.

19. The method of claim 15, wherein the mobile device controls the lighting fixture through the lighting device by wirelessly communicating with lighting device using the access code extracted from the modulated light.

20. The method of claim 15, wherein the mobile device controls the lighting fixture by wirelessly communicating directly with the lighting fixture using the access code extracted from the modulated light.

* * * * *